United States Patent [19]

Smith

[11] Patent Number: 4,700,731

[45] Date of Patent: Oct. 20, 1987

[54] FOLDABLE SHADE STRUCTURE

[76] Inventor: Michael K. Smith, 3021 Oak Ave., #9, Coconut Grove, Fla. 33133

[21] Appl. No.: 677,693

[22] Filed: Dec. 3, 1984

[51] Int. Cl.[4] ..... E04H 15/58; E04H 15/46

[52] U.S. Cl. ..... 135/117; 135/107; 135/112; 248/434; 108/115

[58] Field of Search ..... 135/117, 101, 105, 106, 135/107, 108, 109, 111, 112; 248/434, 461; 108/115, 128

[56] References Cited

U.S. PATENT DOCUMENTS

| | | | |
|---|---|---|---|
| 609,553 | 8/1898 | Lloyd | 135/117 X |
| 835,869 | 11/1903 | Ryan | 135/117 X |
| 901,904 | 10/1908 | Hutchinson | 108/128 |
| 1,773,395 | 8/1930 | Garrett | 135/107 |
| 1,801,014 | 4/1931 | Lange et al. | 135/117 X |
| 2,928,405 | 3/1960 | Lawson | 135/101 X |
| 3,743,345 | 7/1973 | Eckman et al. | 135/117 X |

FOREIGN PATENT DOCUMENTS

| | | | |
|---|---|---|---|
| 2162124 | 12/1971 | Fed. Rep. of Germany | 135/112 |
| 1139425 | 4/1957 | France | 135/107 |
| 2365983 | 6/1978 | France | 248/461 |

OTHER PUBLICATIONS

Eureka, 1975 Quality Camping Tents, Binghamton, N.Y., pp. 11, 16, 18, and 22.

*Primary Examiner*—Robert A. Hafer
*Assistant Examiner*—D. Neal Muir

[57] ABSTRACT

A foldable shade structure is presented. The structure is disposed around a rectangular center to which are coupled U-cross section inner and outer bases. Each of the four outer ends is hingedly coupled to a leg which comprises a leg base coupled to the outer base and at least one leg segment is smaller than the leg segment or leg base beneath it in the extended mode and fits into it in the folded mold. The leg then rotates 270° to fit into the outer base which rotates 180° to fit into the inner base and each of the four inner bases is folded together forming a rectangular center portion into which the shade can be folded and retained. A cord can then hold the composite together and can be coupled to a handle for carrying purposes.

2 Claims, 7 Drawing Figures

FOLDABLE SHADE STRUCTURE

BACKGROUND OF THE INVENTION

1. Field of the Invention

The present invention relates to foldable shade structures which are easily carried.

2. Description of the Prior Art

Tents and shade structures are well known to the prior art. Who cannot remember trying to get a tent put up at night at a new campsite and trying to find which tent pole went where? How many picnics have been saved from sprinkles by having a shade structure that was waterproof where people could stay until the rain stopped? What adult can't remember having trouble putting something like this up? How many times have we gone someplace where we had to stay in the open and just wished that we had something shady to sit under?

The prior describes a bewildering variety of tents and shade structures. Most of these have in common a plurality of parts which are relatively bulky when carried. Some of these plurality of parts can be mislaid.

What the prior art does not disclose is a relatively light essentially two piece (structure and shade) portable foldable shade structure which can be coupled together into a small carrying package. Such a structure is theoretically possible using a telescoping arrangement, but the prior art does not disclose any practical telescoping arrangement for a shade structure.

SUMMARY OF THE INVENTION

A foldable shade structure capable of two positions, an extended position and a folded position is presented. The structure comprises a generally planar center having four edges which in a first example are disposed a 90° angles from each other.

Four generally U-cross section inner bases are each hingedly coupled at an inner end of each inner base to a different one of the four edges of the center and each inner base is generally disposed about an axis, although since they are U-cross sectioned, they cannot be exactly disposed about an axis. By U-cross section could be meant a U having a base coupled to two vertical members at 90° angles or a variety of curves which approximate a U-cross section.

Four outer bases, each having a generally U-cross section are each hingedly coupled at an inner end of the outer base to the outer end of a coupled different inner base. Each outer base is a cross section sufficiently smaller than the cross section of the coupled inner base so that the outer base may be rotated around the hinge to fit into the U of the outer base with inner base oriented 180° from the orientation of the outer base, so that the bottom of the inner base covers the open top of the outer base if the U were sitting with the two sides pointing upwards. Both inner bases and outer bases are generally disposed about axes and when extended, each inner base is generally coaxial to its adjacent outer base. When the inner base is inside the outer base, once again each inner base is generally coaxial to the outer base which is disposed around it.

Four leg bases are each hingedly coupled at a lower end to the outer end of an outer base and each is disposed about an axis. Each leg base when extended is disposed at a 90° angle to the adjacent outer base. When folded, each leg base is rotated 270° from the extended position to fit inside both the U-cross section of the outer base and the U-cross section of the inner base and is generally coaxial with both the inner base and the outer base. The leg base must be rotated the 270° inside the inner base before the inner base is placed inside the outer base.

Four sets of leg segments extend from the leg bases, each leg comprises the leg base and at least one upper leg segment disposed about an axis and having the same cross section shape of the leg base to which it is coupled. Each segment is smaller in cross section and fits inside the leg base or segment which is beneath it in the extended mode and is slightly larger than the one above it and capable of receiving the one above it. Each segment is generally coaxial with the leg base to which it is coupled.

DRAWING DESCRIPTION

Reference should be made at this time to the following detailed description which should be read in conjunction with the following drawings, of which;

FIG. 1 a three-quarter view of a foldable shade structure according to the present invention;

DETAILED DESCRIPTION

Figure 6:
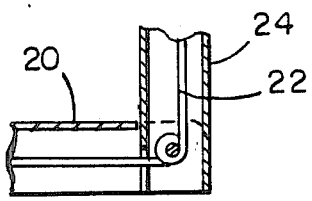
FIG. 6 illustrates a joint between adjacent support structures of the invention of FIG. 1.
Figure 3:
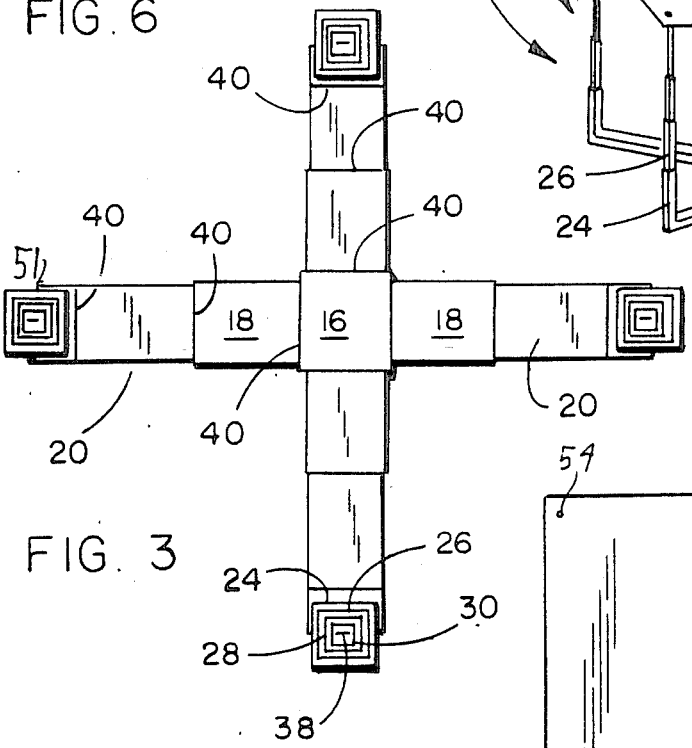
FIG. 3 illustrates a top view of the invention of FIG. 1 with the shade removed.

A foldable shade structure 10 is presented.

The structure 10 comprises a generally planar center 16 having four edges 40 and four corners between the edges 40.

Four generally U-cross section inner bases 18 are each hingedly coupled at an inner end of each inner base 18 to a different one of the four edges 40 of the center 16 and each inner base 18 is generally disposed about an axis (not shown).

Four outer bases 20, each having a generally U-cross section of slightly different size than the cross section of the inner bases 18 are coupled so that one of the U-cross sections of the bases 18–20 can fit into the other. In the example shown, the base 18 has a larger cross section than the base 20 which fits into the base 18. Each outer base 20 is hingedly coupled at an inner end near an edge 40 of the outer base 20 to the outer end near the edge 40 of a coupled different inner base 18 so that when the small base 20 is fitted into the larger base 18, the two bases 18, 20 may be oriented 180° so that the bottom 21 of the inner base 18 covers the open top of the outer base 20 and bottom 31 of the outer base 20 covers the open top of the inner base 18. When extended, each inner base 18 is generally coaxial to its adjacent outer base 20. When one base 20 is fitted inside the other base 18, the inner base is generally coaxial to the outer base 20 which is disposed partially within the coupled inner base 18.

Figure 1:
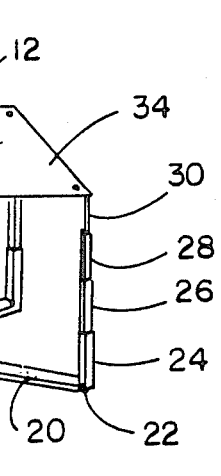
Figure 5:
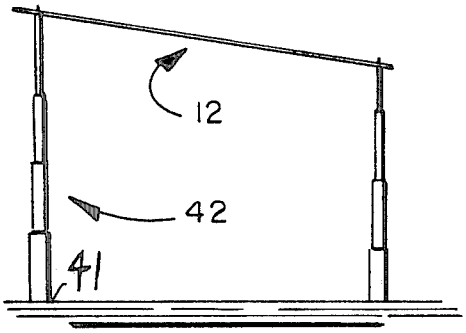
FIG. 5 illustrates a side view of the invention of FIG. 1.

Four leg bases 24 are each hingedly coupled at a lower end 41 as best shown in FIG. 5 to the outer end 51 of a different outer base 20. Each leg base 24 is disposed about an axis 52. Each leg base 24 is capable of rotating to an extended position at a 90° angle above the adjacent outer base 20 as shown in FIG. 1. Each leg base 24 is capable of rotating to an extended position at a 90° angle above the adjacent outer base 20. Each leg base 24 is capable of rotation 270° from the extended position where it is 90° above the adjacent leg base 20 to fit inside both the U-cross section of the outer base 20 and the U-cross section of the inner base 18 and when fitted inside is generally coaxial with both the inner base 18 and the outer base 20 so that when the bases 18,20 are folded, the inner base 18 and outer base 20 form the general cross section of a rectangle with the leg base 24 disposed inside the rectangle.

A plurality of leg segments 26,28,30 extend from each leg base 24. Each leg 42 comprises the leg base 24 and at least one upper leg segment 26,28,30 disposed about an axis 52 (an end view of which is shown as a dot in FIG. 7) coaxial with the leg base 24. The leg segments 26,28,30 have the same cross section shape of the leg base 24 into which each leg segment 26,28,30 is coupled. Each leg segment 26,28, 30 is smaller in cross section than the adjacent cross section leg base 24 or segment 26,28 closer to the inner base 18 and is slidably capable of being removed from the next larger cross section portion of the leg 42.

One spring means 22, best shown in FIG. 6, is coupled between each outer base 20 and the adjoining leg 42 as exerts force causing the leg 42 to rotate 270° from parallel to the inner base 18 to an orientation 90° above the axis of the inner base 18. The orientation is best illustrated in FIG. 1.

Figure 2:
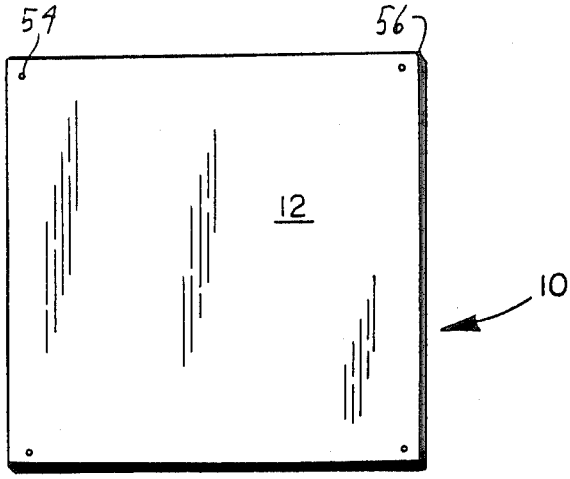
FIG. 2 is a top view of the invention of FIG. 1.

A generally rectangular foldable shade means 12 having four sides and four corners and a surface defining coupling means near each corner is capable of removably coupling to the top 38 of each leg 42 which top 38 is shaped to couple to the coupling means of the shade 12. In the example illustrated in FIG. 2, the coupling means 54 comprise holes defined by the surface of the shade 12 near each corner 56 of the shade 12. A variety of other coupling means known to the prior art may be utilized within the scope of the present invention 10.

Figure 4:
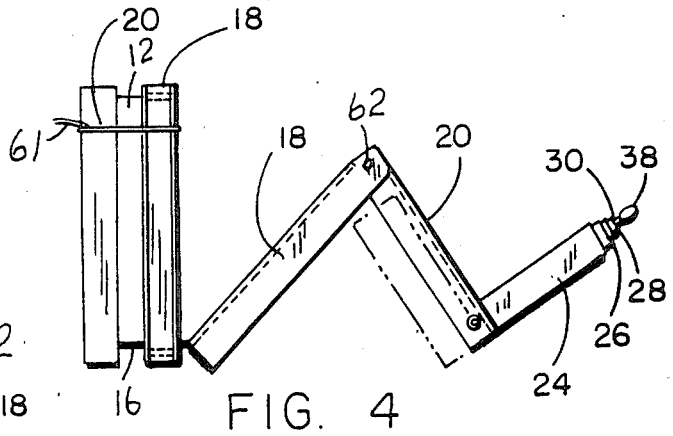
FIG. 4 illustrates the structure of FIG. 3 partially folded.
Figure 7:
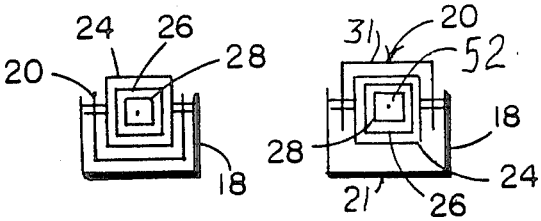
FIG. 7 illustrates a portion of the support structure of the invention of FIG. 1 in a partially cut away side view of two support segments of FIG. 1, one in a totally folded configuration and the other in a partially folded configuration.

As illustrated by the various figures, the shade structure 10 is capable of two positions, and extended position as illustrated in FIG. 1 and a folded position shown in part in FIG. 7. In the folded position, the space between the U-cross section bases 18, 20 is sufficiently large to retain the folded shade means 12 with one pair of bases 18,20 having enclosed the coupled leg 42 on each of four sides disposed at a 90° angle around the center 16 and folded upwards. The space between the outer surfaces of the bases 18,20 is approximately equal to the area of the center 16 which in turn is large enough to form a generally rectangular space into which the folded shade structure 12 is placed. FIG. 4 illustrates the folding together of the shade structure 10. Coupling means may include a cord 61 coupled around the outside of the bases 18, 20 which cord 61 hold the bases 18,20 together with the shade structure 12 inside so that the entire package can be held by the cord 61 or a handle (not shown) coupled thereto. In the folded position best shown in FIG. 4, the space between the U-cross section ases 18, 20 is sufficiently large to retain the folded shade means 12 that further includes coupling means 61 coupling the four bases 18,20 around the foldable shade means 12 to retain the foldable shade means and further including handle means (not shown) coupled to the bases, 18, 20 near the end of the bases 18, 20 which is coupled to the legs 42 and wherein each outer base 20 has a U-cross section sufficiently smaller than the cross section of the coupled inner base 18 so that the outer base 20 may be located around the hinge means 62 which couple the outer base 20 and coupled leg 42 to fit into the U of the inner base 18 with the inner base 18 oriented 180° from the orientation of the outer base 20 as shown on the right side of FIG. 7. The left side of FIG. 7 is an end view of the same or a similar leg 42 when the inner base 18 and outer base 20 are still parallel as shown in FIG. 1 and the leg 42 has been rotated 90° so that it also is parallel to the inner base 18 and outer base 20.

A particular example of the invention has been disclosed herein. Other examples will be obvious to those skilled in the prior art. The present invention is limited only by the following claims: FIG. 6 shows the spring 22 in the position it has when the leg 42 is rotated 180 degrees from the position shown in FIG. 1, as the leg 42 is being rotated 270 degrees to parallel with base 20.

I claim:

1. A foldable shade structure, comprising:

a generally planar center having four edges and four corners;

four generally U-cross section inner bases, each hingedly coupled at an inner end of each inner base to a different one of the four edges of the center and each inner base generally disposed about an axis;

four outer bases each having a generally U-cross section of slightly smaller size than the inner bases so that the smaller U-cross sections can fit into the larger, each outer base is hingedly coupled at an inner end of said outer base to the outer end of its associated inner base so that when the small base is fitted into the larger, the two bases are interfitted so that the bottom of the inner base covers the open top of the outer base and the bottom of the smaller outer base partially covers the open top of the inner base and when extended each inner base is generally co-axial to its adjacent outer base and when one base is fitted inside the other, the inner base is generally co-axial to the outer base which is disposed partially within the inner base;

four leg bases each hingedly coupled at a lower end to the outer end of a different outer base and each leg base disposed about an axis, each leg base being capable of rotating to an extended position at a 90° angle above the adjacent outer base, and each leg base being capable of rotation 270° from the extended position to fit inside the U-cross section of the outer base which in turn fits inside the U-cross section of the inner base and when so folded is generally co-axial with both the inner base and the outer base so that when the bases are folded, the inner base and outer base form the general cross section of a rectangle with the leg base disposed inside the rectangle;

a plurality of upper leg segments extending from each leg base, each leg comprising the leg base and at least one upper leg segment disposed about an axis co-axial with the leg base and having the same cross section shape of the leg base into which it is coupled, each segment being smaller in cross section than the adjacent cross section close to the inner base and slidably coupling into the adjacent portion of the leg closer to the inner base and slidably being capable of being extended from the next larger portion of the leg;

one spring means coupled between each outer base and leg and exerting force causing the leg to rotate 270° from the interfitted folded position the inner base to an orientation 90° above the axis of the inner base; and a generally rectangular foldable shade means having four sides and four corners and a surface defining coupling means near each corner capable of removeably coupling to the top of each leg.

2. The invention of claim 1 wherein the shade structure is capable of two positions, an extended position and a folded position, and in the folded position, the space between the U-cross section bases is sufficiently large to retain the shade means and further including coupling means coupling the four bases around the foldable shade means to retain the foldable shade means and further including handle means coupled to the bases near the end of the bases which is coupled to the legs and wherein the each outer base has a U-cross section sufficiently smaller than the cross section of the coupled inner base so that the outer base may be rotated around the hinge means which couple the outer base and coupled leg to fit into the U of the inner base with inner base oriented 180° from the orientation of the outer base.

* * * * *